US005980394A

United States Patent [19]

Domas

[11] Patent Number: 5,980,394

[45] Date of Patent: Nov. 9, 1999

[54] GOLF CLUB WOODHEAD WITH OPTIMUM AERODYNAMIC STRUCTURE

[76] Inventor: Andrew A. Domas, P.O. Box 916, Joliet, Ill. 60434

[21] Appl. No.: 08/752,195

[22] Filed: Feb. 10, 1997

Related U.S. Application Data

[63] Continuation-in-part of application No. 08/152,310, Nov. 12, 1993, abandoned.

[51] Int. Cl.[6] ..... A63B 53/04

[52] U.S. Cl. ..... 473/327; 473/328; 473/345; 273/DIG. 14

[58] Field of Search ..... 473/324, 327, 473/328, 330, 331, 332, 343, 344, 345, 346, 349, 350, 228; D21/214; 273/DIG. 14

[56] References Cited

U.S. PATENT DOCUMENTS

| | | |
|---|---|---|
| D. 351,441 | 10/1994 | Iinuma . |
| 3,997,170 | 12/1976 | Goldberg . |
| 4,065,133 | 12/1977 | Gordos . |
| 5,004,241 | 4/1991 | Antonious . |
| 5,203,565 | 4/1993 | Murray . |
| 5,221,086 | 6/1993 | Antonious . |
| 5,242,167 | 9/1993 | Antonious . |
| 5,335,914 | 8/1994 | Long . |

FOREIGN PATENT DOCUMENTS

| | | |
|---|---|---|
| 0000538 | 1/1977 | Japan . |

*Primary Examiner*—Sebastiano Passaniti
*Attorney, Agent, or Firm*—Joanne M. Denison; Denison & Assocs PC

[57] ABSTRACT

The present invention consists of an improved wood head or driver design for a golf club in which the wood head or driver is preferably molded from a clear acrylic material or polymeric material or a high tech metal alloy wherein a plurality of elongated elliptical and/or V-shaped grooves or indentations extend normal to the club head striking surface and are embedded in the crown, toe and sole of the club head. These grooves initiate from just behind the striking face or leading edge, and extend rearwardly toward the back of the club wood head. The grooves create a corresponding plurality of vortices during the golf swing which redirect air flow rearwardly away from the back of the club head, reducing drag and the wind resistance of the moving club head, which in turn increases thrust and the overall distance a golf ball is capable of travelling during a given shot.

11 Claims, 3 Drawing Sheets

GOLF CLUB WOODHEAD WITH OPTIMUM AERODYNAMIC STRUCTURE

This application is a CIP of application Ser. No. 08/152,310, filed Nov. 12, 1993, now abandoned.

FIELD OF THE INVENTION

The present invention relates generally to the field of golf clubs, and in particular, to golf club wood heads (commonly known as the No. 1 wood or driver, as well as Nos. 2, 3, 4, etc.) Specifically, this particular field of golf club wood head design utilizes certain aerodynamic structural improvements which result in performance enhancement.

DESCRIPTION OF THE PRIOR ART

A traditional gold club wood head is inherently wind resistant due to the nature of its flat face on the leading edge of the swing, and its somewhat rounded body. This results in a greatly reduced club head velocity during a golf down swing. Although there are numerous known club head structures and designs disclosed in the prior art, such as the Sinclair patent, U.S. Pat. No. 4,900,029 which discloses the use of a golf club head with a singular large top vertical air foil cavity; the Gordos patent, U.S. Pat. No. 4,065,133, which discloses the use of an aerodynamic upper surface containing a plurality of shallow grooves normal to the club face; the Goldberg Patent, U.S. Pat. No. 3,997,170, which discloses the use of a plurality of parallel grooves formed in the upper or top face of a golf club wood head which are normal to the striking face and are used for the purpose of visually indicating the desired direction of the stroke; and the design patents of Chorne, U.S. Pat. No. D326,130 which shows the use of a single large v-shaped gorge along the backside of a club head; the Jansky U.S. Pat. Nos. D94,549 which shows two opposing lateral v-shaped grooves in the underside of a club head; and Jansky U.S. Pat. No. D944,550 which shows the use of a single lateral v-shaped groove in the underside of a club head; and Duaguard U.S. Pat. No. D332,476 which shows the use of a single v-shaped gorge along the front face of a club head, none of the aforementioned prior art disclosures teach an improved golf club wood head containing all of the features and advantages of the present invention.

In playing the game of golf, it is not brute physical power in a golfer's swing that determines the ultimate distance a golf ball is capable of travelling. It is the amount of club head velocity a golfer can generate during an arcuate down stroke of the golf swing. Therefore, by properly embedding curved surfaces into a golf club wood head body, this increases air velocity around the golf head wood body especially into the vortices and through the vortices, hence decreasing resistance and drag, thereby increasing the speed of the club before it strikes the ball, resulting in increased flight distance travelled by the ball.

SUMMARY OF THE INVENTION

The present invention consists of the strategic location of vortex generators or elongated indentations in the body of a golf club wood head. In the case of the present invention, in one preferred embodiment, five vortex generators are located on the surface of the golf club wood head; two in the top or crown of the wood head, two in the toe portion of the wood head, and the last or fifth single vortex generator is centrally positioned in the sole or underside of the golf club wood head. These five vortex generators or indentations are represented as depressions or embedments into the golf club wood head. The two crown vortex generators begin at a point just rear of the striking face or leading edge of the club wood head and flare outward as they extend toward the back of the golf club wood head. They follow the normal body contour of the wood head. The two toe vortex generators begin at a point somewhat closer to the leading edge or face line and extend parallel to one another toward the rear of the club head toe and terminate at the point just therebefore. The single sole or underside vortex generator begins at a point just rear of the ball striking face or leading edge of the golf club wood head and flares outwardly as it extends toward the back of the wood head. All of the aforementioned vortex generators are consistent in depth along their length.

During an arcuate golf downswing, the club face and body create pressures in the air in front of the front or leading edge of the golf club wood head which disrupts the static stability of the air. During the continuum of the down swing, the pressure of the air in front of the club face converts the static stability into dynamic stability of the same disturbed and pressured air, forcing the air to flow over the crown or top, under the sole and around the toe and heel of the club head. As the air flow over the crown begins to pass over the openings therein of the vortex generators or indentations, the naturally occurring boundary layer of air is disrupted, creating a vortex and forming a vacuum that draws the air flow into each of said vortex generators at an accelerated speed, forcing that accelerated air flow through said vortex generators and directing the faster moving air out of the aforementioned rearward open terminal ends of the club head. This accelerated air flow into and through the two crown vortex generators would normally produce forward and downward forces on the club head throughout the duration of the arcuate motion of the down swing.

The resultant forward and downward forces created by the crown vortex generators, in addition to the counterbalancing and other forces described below, follow the laws of aerodynamics wherein certain components changing or redirecting the natural air flow direction are capable of producing significant increases in force on any moving body passing through air, much similar to the mechanism by which a curved wing produces lift.

In this case, however, the sole vortex generator positioned in the underside of the club wood head creates similar but forward and upward force on the club wood head which counterbalances the downward forces created by the dual crown vortex generators. Thus, the dynamic stability of the dual crown and single underside vortex generators, by offsetting the downward and upward forces present on the golf club wood head, focuses entirely on the forward forces created by both the crown and underside vortex generators, resulting in a net increase in force upon the golf wood head which is actually greater than that created by normal drag on a golf wood head club during an arcuate downswing.

In addition to this effect, the dual toe vortex generators serve three distinct functional advantages as a result of the accelerated air flow into and through these embedments: 1) additional forward thrust, 2) promotion of a truer flight plane during the down swing, and 3) lateral thrust away from the toe and toward the rear of the golf club wood head which assist in promoting an inside out down swing plane.

Therefore, during a golf down swing, the aerodynamic forces created by the vortex generators in the crown, underside and toe create a net forward thrust which is proportionate to the amount of club wood head velocity produced by a golfer of any skill level. These vortices create a net forward thrust sufficient to overcome all naturally occurring wind resistance and drag present during the use of conventional shaped club wood heads. By harmoniously harnessing the static and dynamic stability of air flow around, into and through the vortex generators, optimum aerodynamic advantage is achieved though the generation of greater club wood head velocity during any arcuate down swing, ultimately resulting in a measurable improvement of the overall distance a golf ball will travel.

An additional benefit of the quintuple vortex driver is that it provides a self-correcting mechanism for off center ball strikes. By the strategic location of the vortex generators in the crown, underside and toe, the displaced weight is naturally redistributed toward the toe and heel of the club, with a greater amount of weight falling in the vicinity of the toe. The heel area, on the other hand, is adapted for attachment to a shaft which transmits the driving power during a down swing. Because the wood head is heavier in the area of the toe, it is better balanced during a swing, when the heel portion is transmitting the main driving force of the swing. Thus, the present invention results in a more balanced strike of the ball due to a balanced weight and power distribution system that can measurably narrow the shot dispersion pattern and markedly improve overall accuracy, especially when this feature is combined with the aerodynamic net forward thrust also created by the quintuple vortex generators.

It is important to note that it would be very inadvisable to position a vortex generator into the heel or anywhere adjacent the shaft mounting area at the hosel to the sole on the heel side of the club head wood, especially on standard or mid-sized gold club wood heads. The decrease in material in this portion of the club wood head could cause the club wood head to shatter upon impact at or around the heel area. Conversely, it may be possible to position a vortex generator into the heel of a jumbo wood head, as a jumbo wood head may have sufficient structural support to accommodate the resultant decrease in material present.

Because of surface constraints on smaller-headed, higher-lofted golf club wood heads, such as the number 5, number 7 and number 9 fairway woods, such smaller, more naturally streamlined golf club wood heads may require a simplified tri-vortex generator system: either a single vortex generator indentations embedded into the crown, sole and toe, toe surface permitting; or, the toe vertex generator may be repositioned proportionately to the crown and/or sole of the golf club wood head with two similar, essentially parallel and proportionate vortex generator embedments in the crown with a single vortex generator indentation in the sole, or vice versa. The necessary repositioning eliminates potential structural weaknesses at or about limited golf club wood head toe surfaces, thereby providing the some forward force focus, aerodynamic and physical advantages as the first preferred embodiment described herein. Conversely, multiple vortex generator systems, or multiple indentation embedments may be strategically positioned within each of the actuatable surfaces of the crown, sole, toe, and possibly even the heel, where jumbo size heads allow for structural integrity, providing similar or greater aerodynamic and physical benefits.

While the optimum aerodynamic and physical advantages of the present invention may be achieved when applied to hollow bodied shell steel wood heads, composite graphite wood heads, and light weight aluminum/titanium alloy wood heads, all of which are commonly available in the market place today, the preferred material for the present invention would consist of a solid body construction of light weight resinous or polymeric compounds of considerable density. It is a basic law of physics that solid body constructions retain greater potential energy compared with their hollow bodied equivalent structures. It is this physical principal which would result in a more explosive release of the golf ball when it is struck with the golf club wood head described herein.

OBJECTS OF THE INVENTION

Thus it is a primary object of the present invention to provide a golf club wood head which effectively and harmoniously harnesses the naturally occurring aerodynamic forces created during a golf club down swing.

It is a further primary object of the present invention to provide such a golf club wood head without sacrificing the visually classic appearance, at address and throughout the golf swing, which is most widely accepted by generations of golfers of all skill levels.

It is a further primary object of the present invention to provide a multiple vortex generator golf wood head system which results in a net thrust of additional force generated during an arcuate golf down swing that is capable of producing greater flight of the ball.

It is yet another primary object of the present invention to provide a multiple vortex generator golf wood head system which concentrates the greater weight of the golf wood head near the toe of the club, resulting in a more accurate swing that is less sensitive to off center strikes.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

DETAILED DESCRIPTION OF THE DRAWINGS

Figure 1:
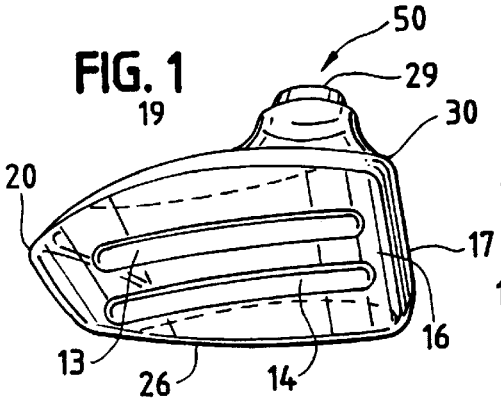
FIG. 1 is a toe or front elevation of a no. 1 wood or driver golf club wood head with two vortex generators positioned in the toe portion of the golf club wood head.

Referring to FIGS. 1 through 4, these figures show one preferred embodiment of the present invention wherein a golf club wood head 50 is provided with five vortex generators positioned normal to the striking face 17. FIG. 1 shows golf club wood head 50 in elevational end view detailing the location of two toe vortex generators or indentations 13 and 14. A preferable dimensioning of the vortex generators 13 and 14 is as follows: overall lengths are 2.050 inches; overall widths are 0.10 inches; height of toe 16 from underside 26 to crestline 30 is 1.40 inches.

Figure 2:
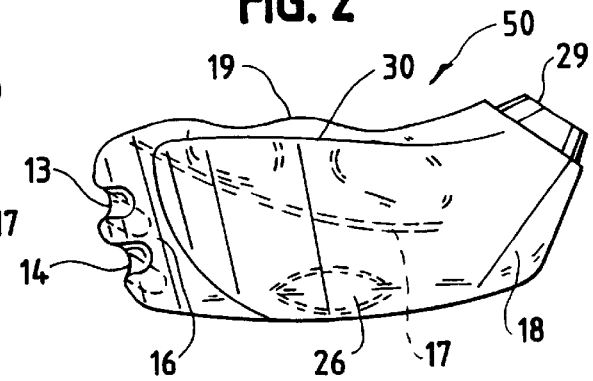
FIG. 2 is a left side elevation view of the preferred embodiment of present invention shown in FIG. 1.

FIG. 2 shows an elevational view of the golf club wood head 50 where striking face 17 is shown in full view. Vortex generators or indentations 13 and 14 are now shown in side view along toe 16. A preferable dimensioning is as follows: overall length from toe 16 to heel 18 is 4.175 inches; underside 26 length is 3.350 inches; overall height from underside 26 to crown 19 apex is 1.50 inches; striking face 17 height from underside 26 to crestline 30 is 1.40 inches.

Figure 3:
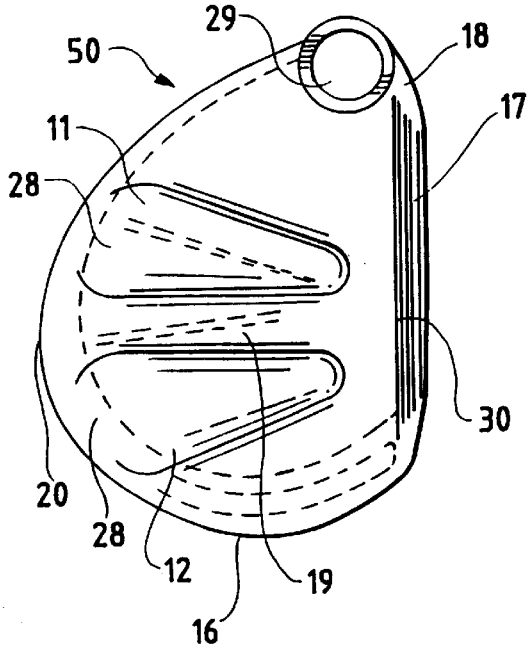
FIG. 3 is a crown plan view of the preferred embodiment of the present invention shown in FIG. 1 showing two vortex generators positioned in the crown of the golf club wood head body.

FIG. 3 illustrates a top plan view of golf club wood head 50 showing crown 19 and crown vortex generators or indentations 11 and 12. A preferable dimensioning is as follows: overall golf club wood head length from the outwardmost point of shaft mounting area 29 to the apex of toe 16 is 4.175 inches; overall width from back 20 of golf club wood head 50 to the leading edge of striking face 17 is 3.725 inches; the width of each crown vortex generator or indentation 11 and 12 at the crownline (which is approximately the center of gravity of golf club wood head 50) is 0.975 inches, flaring rearwardly toward back 20 to open terminal ends 28.

Figure 4:
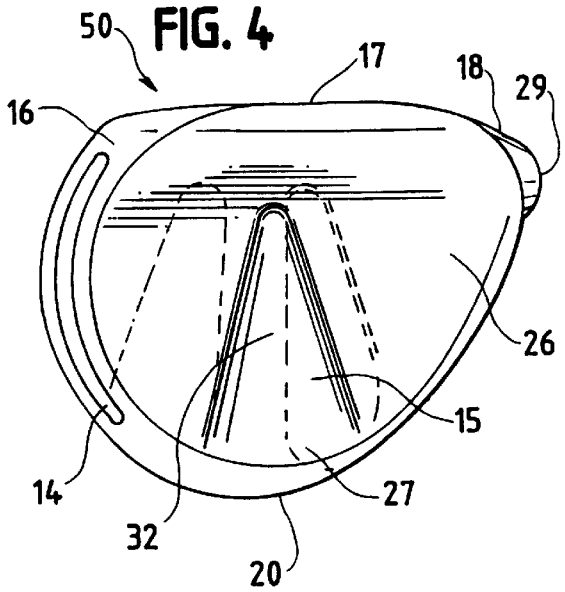
FIG. 4 is an underside or bottom plan view of the preferred embodiment of the present invention shown in FIG. 1 showing the fifth vortex generator positioned in the underside of the golf club wood head body.

FIG. 4 shows a bottom plan view of the golf club wood head 50 illustrating the underside 26 and depicting, again, the preferred location and configuration of underside vortex generator or indentation 15 in underside 26, as well as its general relationship to toe vortex generator or indentation 14 near the bottom of toe 16. A preferred relative dimensioning is as follows: overall length of the underside 26 or bottom is 3.50 inches; the width of the underside 26 from the leading edge of striking face 17 to the outermost edge of open terminal end 27 consistent with the normal body contour is 2.75 inches; width of underside vortex generator or indentation 15 at the crown apex point 32, or the apex of crown 19 of golf club wood head 50 is 1.250 inches, and the depth of vortex generator or indentation 15 at the same crown apex point 32 is 0.225 inches; the leading edge or crestline 30 of striking face 17 to the crown apex point 32 is approximately 1.00 inches.

FIGS. 1 through 4 illustrate the preferred locations, depths, and dimensions of the five vortex generators or indentations as incorporated into one preferred configuration of the present invention, and such a configuration is especially preferred when the golf club wood head is constructed in sold body form with a resinous compound such as acrylics, or acrylic based polymers. These dimensions, depths, and locations of the vortex generators may vary; nonetheless the inventive concept disclosed herein may be adapted to hollow bodied designs, such as steel, composite graphite, lightweight aluminum alloys, as well as to other recently discovered and/or applied space age materials. Minute shrinkage occurring during the manufacturing process should not be a design problem, even when molds are made to the dimensions given herein. The present invention may even be adapted to golf club wood heads where space is a consideration on smaller headed, higher lofted fairway and "trouble" woods, such as the nos. 7 and 9, for example.

Figure 5:
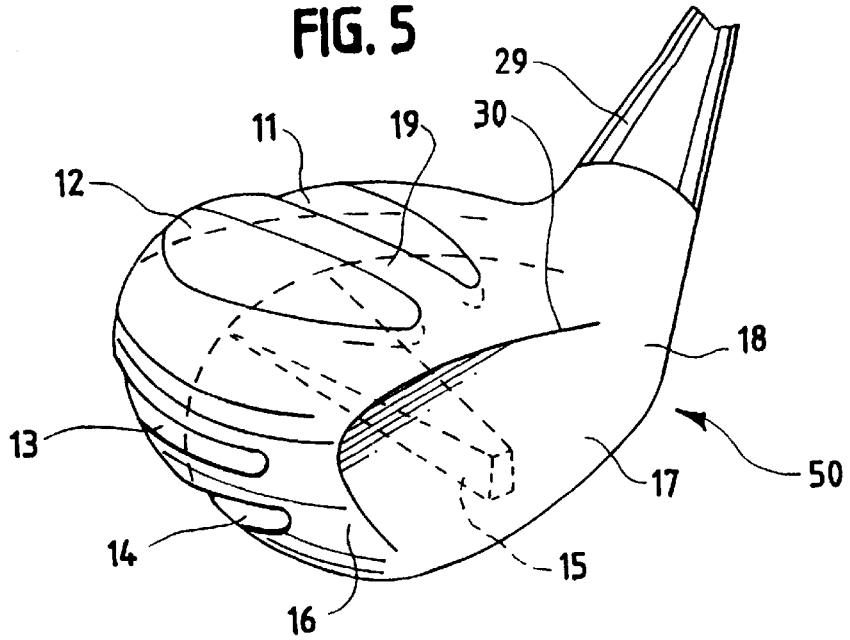
FIG. 5 is a perspective view of the preferred embodiment of the present invention shown in FIG. 1 showing its aerodynamic features during a down swing.

FIG. 5 shows a perspective view of golf club wood head 50 showing all the primary elements of the crown 19 and toe 16 containing vortex generators 11, 12, 13 and 14 and indicating the sole or underside 26 vortex generator 15 along the outer perimeter of the golf club wood head 50.

Figure 6:
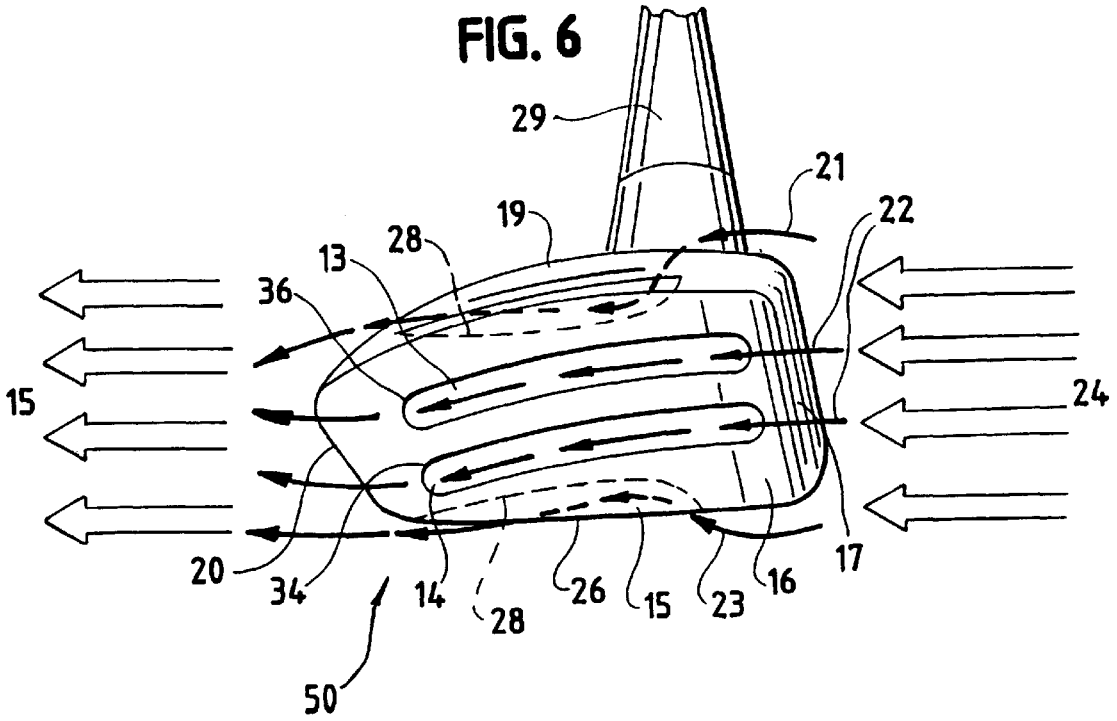
FIG. 6 is a front elevation of the preferred embodiment of the present invention shown in FIG. 1 showing its aerodynamic features during a down swing.

FIG. 6 illustrates the harmonious harnessing of the aerodynamic forces acting on golf club wood head 50 during a down swing. From the top of an arcuate down swing of a golf club wood head 50, the striking face 17 of golf club wood head 50 exerts pressure (schematically indicated) on the stability of static air 24, directing the upper flow of air 21 over crown 19, the central flow of air 22 around toe 16, and the lower flow of air 23 properly around the golf club wood head 50.

As the upper flow of air 21 begins to pass over the two crown vortex generators 11 and 12, a vacuum is created. The upper flow of air 11 is drawn into crown vortex generators or indentations 11 and 12 by this vacuum, causing the flow of upper air 21 to move at a faster rate of speed than the club head, and it directs the accelerated air flow out the open terminal ends 28 of the crown vortex generators or indentations 11 and 12 at the rear 20 of golf club wood head 50. The underside vortex generator or indentation 15 draws the lower flow of air 23 into underside vortex generator or indentation 15 by means of a vacuum, accelerates the air to a speed greater than that of club head wood head 50 and then forces the lower flow of air 23 out the open terminal end 28. The two toe vortex generators or indentations 13 and 14 around toe 16, by means of a vacuum, draw the central air flow 22 into toe vortex generators or indentations 13 and 14. However, because of the closed terminal ends 34 and 36 at the rear of vortex generators or indentations 13 and 14, additional pressure is created in the area of terminal ends 34 and 36. An inwardly acting force tends to counter balance the forward forces created along the shaft mounting area 29 and heel 18 areas during the golf down swing producing a truer and straighter swing. This phenomena is especially effective when used in combination with the accelerated air flows 21, 22 and 23 drawn into vortex generators or indentations 11, 12, 13, 14 and 15 which are sufficient enough to produce a net forward thrust greater than wind resistance and drag around the golf club wood head 50 body.

Figure 7:
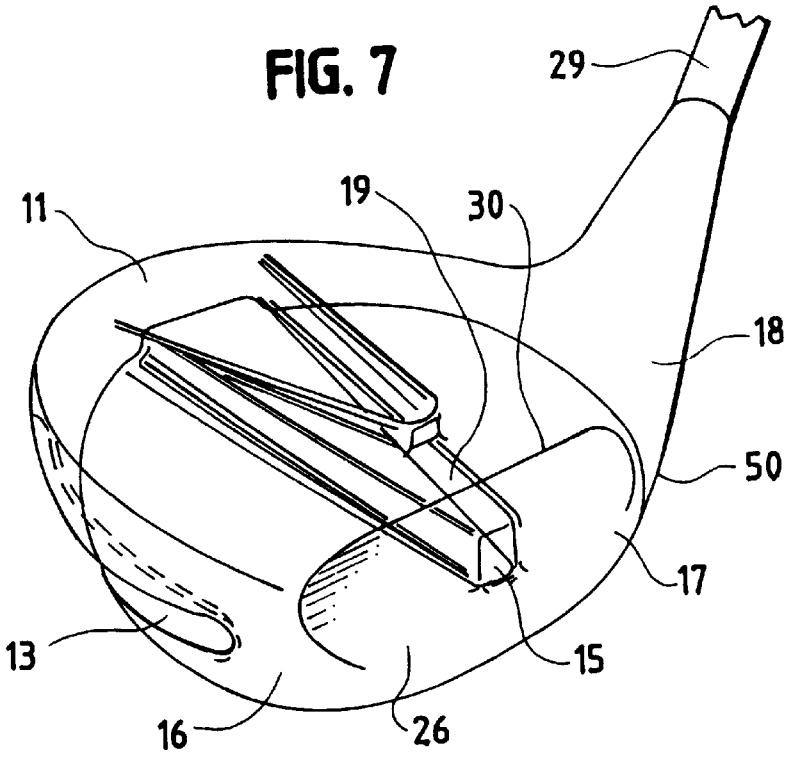
FIG. 7 is a perspective view of the simplified preferred embodiment of the present invention adopted to fairway-sized and/or more streamlined golf club wood head configurations.
Figure 8:
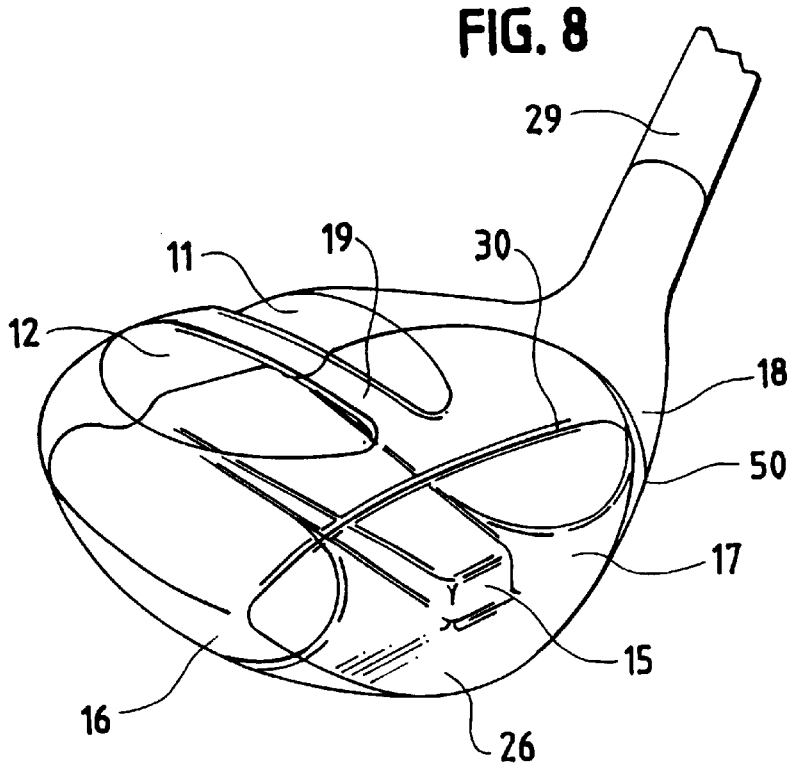
FIG. 8 is a perspective view of the tri-vortex preferred embodiment of the present invention adapted to fairway-sized and/or more streamlined configurations eliminating structural weakness at or about limited toe area surfaces, yet providing the integrity of the forward force focus inherent to the present invention.

FIGS. 7 and 8 illustrate the preferred locations of the vortex generators or indentations as incorporated into additional preferred configurations of the present invention in its simplified expression to accommodate smaller, higher-lofted and more naturally streamlined golf club wood heads, wherein the integrity of the forward force focus and weight distribution advantages, the substance of the present invention, are essentially maintained, thereby eliminating potential structural weaknesses at or about limited toe area surfaces. While substantially similar, the depth, dimension, and location of the vortex generators or indentations in this art may vary according to the aerodynamic response preferred.

FIG. 7 shows a perspective view of golf club wood head 50 illustrating the primary elements of the crown 19, toe 16, and sole or underside 26 containing vortex generators 11, 13 and 15 along and embedded within the outer perimeter of the golf club wood head 50.

FIG. 8 shows a perspective view of golf club wood head 50 illustrating the primary elements of the crown 19, sole or underside 26, and an extreme example of minimized, limited toe 16 area surface, wherein consequently vortex generators or indentations 11, 12, and 15 are embedded into the crown 19 and sole or underside 26 along the outer perimeter of golf club wood head 50.

FIGS. 7 and 8 follow the same laws of aerodynamics as expressed in FIG. 6 of the present invention, the harmonious harnessing of aerodynamic forces acting positively on such a designed golf club wood head during an arcuate golf downswing.

These and other objects and advantages of the present invention can be readily derived from the following detailed description of the drawings taken in conjunction with the accompanying drawings present herein and should be considered as within the overall scope of the invention.

What is claimed is:

1. A golf club wood head comprising:

a club body;

said club body having a ball striking surface, a crown surface, a toe surface, a rear surface, a heel surface, and an underside surface;

at least one vortex generating means having a gently curving aerodynamic configuration capable of inducing a force against the club surface wherein each vortex generating means located within each of the crown, toe and underside surfaces extend rearwardly from just behind a plane containing the ball striking surface;

at least one of the vortex generating means in the crown surface which flares outwardly towards the heel and toe surfaces as it extends towards the rear surface of the club wood head body and having an open terminal end adjacent the rear surface of the club wood head body and is dimensioned to produce net lift and thrust during a golf swing;

at least one of the vortex generating means in the toe surface extends from adjacent the striking surface to a closed terminal end located adjacent the rear surface of the club wood head body and is dimensioned to produce net lift and thrust during a golf swing;

at least one of the vortex generating means in the underside surface is located substantially centrally between the heel and toe surfaces and the vortex generating means flares outwardly towards the heel and toe surfaces as it extends towards the rear surface of the club wood head body and having an open terminal end adjacent the rear surface of the club wood head body and is dimensioned to produce net lift and thrust during a golf swing;

and each of the vortex generating means in the crown, toe and underside surfaces are substantially equal in depth along their respective lengths;

whereby the aerodynamic forces created by the vortex generating means in the crown and underside surfaces create a net lift and thrust during a golf swing.

2. The golf club wood head according to claim 1 wherein the at least one vortex generating means in the underside surface is substantially v-shaped.

3. The golf club wood head according to claim 2 wherein each indentation is substantially elliptical in configuration in the toe surface.

4. The golf club wood head according to claim 1 wherein the golf club wood head is made from one or more materials selected from the following group: an acrylic, a polymeric based material or a metal alloy.

5. The golf dub wood head according to claim 1 wherein there are at least two vortex generating means positioned in the toe surface.

6. The golf club wood head according to claim 1 wherein there ore at least two vortex generating means positioned in the crown surface.

7. The golf club wood head according to claim 1 wherein there is one vortex generating means positioned in the underside surface.

8. A golf club wood head comprising:

a club body;

said club body having a ball striking surface, a crown surface, a toe surface, a heel surface, a rear surface, and an underside surface;

at least one substantially elliptical indentation embedded in the toe surface and at least one v-shaped indentation in each of the crown and underside surfaces flaring outwardly towards the heel and toe surfaces as each indentation extends towards the rear surface of the club wood head body with the v-shaped indentation in each of the crown and underside surfaces dimensioned to produce a net lift and thrust during a golf club swing;

each of the v-shaped indentations being oriented substantially normal to a plane containing the ball striking surface;

each of the v-shaped indentations in the crown and underside surfaces being substantially equal in depth along their respective lengths;

whereby the aerodynamic forces created by the indentations create a net lift and thrust during a golf club swing.

9. The golf club wood head according to claim 8 wherein the golf club wood head is made from one or more materials selected from the following group: an acrylic, a polymeric based material or a metal alloy.

10. The golf dub wood head according to claim 8 wherein there ore at least two substantially elliptical indentations embedded in the toe surface.

11. The golf club wood head according to claim 8 wherein there are at least two v-shaped indentations flaring rearwardly embedded in the crown surface.

* * * * *